US008750692B2

(12) United States Patent
Irrera et al.

(10) Patent No.: US 8,750,692 B2
(45) Date of Patent: Jun. 10, 2014

(54) ELECTRIC AIR HEATER, IN PARTICULAR FOR ELECTRICAL DOMESTIC APPLIANCES

(75) Inventors: Angelo Irrera, San Vendemiano (IT); Gianni Palu, Santa Lucia di Piave (IT)

(73) Assignee: I.R.C.A. S.p.A. Industria Resistenze Corazzate e Affini, San Vendemiano (IT)

( * ) Notice: Subject to any disclaimer, the term of this patent is extended or adjusted under 35 U.S.C. 154(b) by 0 days.

(21) Appl. No.: 13/639,001

(22) PCT Filed: Apr. 1, 2011

(86) PCT No.: PCT/IB2011/051416

§ 371 (c)(1),
(2), (4) Date: Oct. 2, 2012

(87) PCT Pub. No.: WO2011/121577

PCT Pub. Date: Oct. 6, 2011

(65) Prior Publication Data

US 2013/0028579 A1 Jan. 31, 2013

(30) Foreign Application Priority Data

Apr. 2, 2010 (IT) ..... RM2010A0156

(51) Int. Cl.
*F24D 13/00* (2006.01)
*H05B 3/16* (2006.01)

(52) U.S. Cl.
USPC ..... 392/347; 392/360; 219/543

(58) Field of Classification Search
None
See application file for complete search history.

(56) References Cited

U.S. PATENT DOCUMENTS

| | | | | |
|---|---|---|---|---|
| 3,898,426 | A * | 8/1975 | Maake | 392/350 |
| 4,151,398 | A * | 4/1979 | Maake | 219/532 |
| 8,395,089 | B2 * | 3/2013 | Bohlender et al. | 219/202 |
| 2003/0016953 | A1 | 1/2003 | Wilson | |

FOREIGN PATENT DOCUMENTS

| | | |
|---|---|---|
| DE | 16 15 246 B1 | 2/1973 |
| EP | 0995 830 A2 | 4/2000 |
| GB | 2 089 626 A | 6/1982 |

OTHER PUBLICATIONS

Intl Search Report, Sep. 2, 2011, Intl Search Authority.

* cited by examiner

*Primary Examiner* — Thor Campbell
(74) *Attorney, Agent, or Firm* — Sampson & Associates, P.C.

(57) ABSTRACT

Electric air heater, in particular for electrical domestic appliances, comprising at least one heating element (20) provided with an insulated supporting element (21) on which at least one resistance wire (22) is wound. An electrical connector (17) clamps, with at least one electrical pin (18), said at least one heating element (20), tapping at least one end of said resistance wire (22). The electrical connections of a thermostat (15) and/or a thermistor (14) are made by means of electrical tracks (16) formed directly on a surface (25) of housing (13) to which said thermostat (15) and/or thermistor (14) are attached. Said electrical connector (17) clamps said surface (25) with at least one further electrical pin.

3 Claims, 5 Drawing Sheets

ELECTRIC AIR HEATER, IN PARTICULAR FOR ELECTRICAL DOMESTIC APPLIANCES

FIELD OF THE INVENTION

The present invention relates to an electric air heater, in particular for electrical domestic appliances such as tumble dryers or for industrial applications in which it is necessary to produce hot air.

PRIOR ART

Heaters for hot air are used in some electrical domestic appliances and industrial equipment. The prior art envisages the use of at least one resistance wire wound in air and in coils to define, for example, a cylindrical surface.

A heater generally comprises a plurality of resistance wires, placed alongside the respective axes of the respective developments parallel to one other.

For the purpose of supporting said resistance wires, one or more supporting elements are provided, made of a suitable insulating material, generally having a planar development perpendicular to the axes of the developments of said windings.

This assembly, comprising the windings and the associated supports, is housed in a suitable housing, generally in the form of a parallelepiped, lacking two opposite sides parallel to the axis of development of the windings.

FIG. 1, of the prior art, shows a heater comprising a plurality of resistance wires 1, insulating supports 2, a housing 3, thermostat 4, thermistor 5, wiring 6 and electrical connector 7.

According to a first aspect, assembly of said resistance wires and said supporting elements is carried out manually, involving a notable expenditure of time and thus of economic resources.

According to another aspect, said resistance wires are connected to one another and, through suitable wiring, to a source of electric power.

Production of said wiring also involves an enormous expenditure of time. In fact, the wiring comprises insulated cables that must be stripped and suitably connected to the resistance wires, as well as being clamped in an electrical connector.

This operation can prove even more complex, when, for protection of the heater, a thermostat and/or a thermistor are provided, physically attached to one side of the housing, since these too must be connected electrically by additional wiring, the terminals of which must also be clamped in said electrical connector.

SUMMARY OF THE INVENTION

The present invention solves the aforementioned problems by providing a heater that is extremely simple to assemble and can largely be produced by means of automated industrial processes.

The present invention relates to an electric air heater, in particular for electrical domestic appliances, which, according to claim 1, comprises at least one flat heating element, provided with a flat insulating supporting element on which at least one resistance wire is wound, configured so as to define a substantially flat winding.

The adjective "flat" means in this description that the object to which this applies is a three-dimensional object in which one of the dimensions is negligible relative to the other two dimensions.

Advantageously, a heating element can be made by machine, by winding at least one resistance wire directly on an insulating supporting element. Moreover, the rigidity of the heating element comprising the wire-support assembly makes it possible to clamp an electrical connector directly on the support, tapping mechanically, with the electrical pins, the resistance wire(s) in a single operation, which can be carried out by machine, eliminating the electric wiring.

According to a further aspect of the invention, it is further possible to eliminate the wiring relating to the thermostats and/or thermistors by producing suitable electrical tracks on one face, for example external, of the housing in which said at least one heating element is housed.

According to a first preferred embodiment of the invention, said thermostat and/or thermistor are connected electrically by electric cables, the ends of which are clamped in the same connector that is clamped on the heating element.

According to a further embodiment, said thermostat and/or thermistor are connected electrically by electrical tracks formed on one face of the surface of the housing and a further electrical connector is clamped directly on said surface of the housing, tapping said electrical tracks with the associated electrical pins.

According to another embodiment a single electrical connector, comprising electrical pins of different length, is clamped either on said at least one heating element, or on the surface of the housing comprising said electrical tracks.

Advantageously, elimination of the operation of manual assembly of the resistance wires with the supporting elements and elimination of the operation of connecting the wiring makes it possible to reduce or even eliminate human intervention in the manufacture of said heaters.

The dependent claims describe preferred embodiments of the invention, forming an integral part of the present description.

BRIEF DESCRIPTION OF THE DRAWINGS

Further characteristics and advantages of the invention will become clearer from the detailed description of preferred, but not exclusive, embodiments of an electric air heater, illustrated as examples and non-limiting, referring to the appended drawings, in which.

In the diagrams, the same reference numbers and letters identify the same elements or components.

DETAILED DESCRIPTION OF PREFERRED EMBODIMENTS OF THE INVENTION

Figure 3:
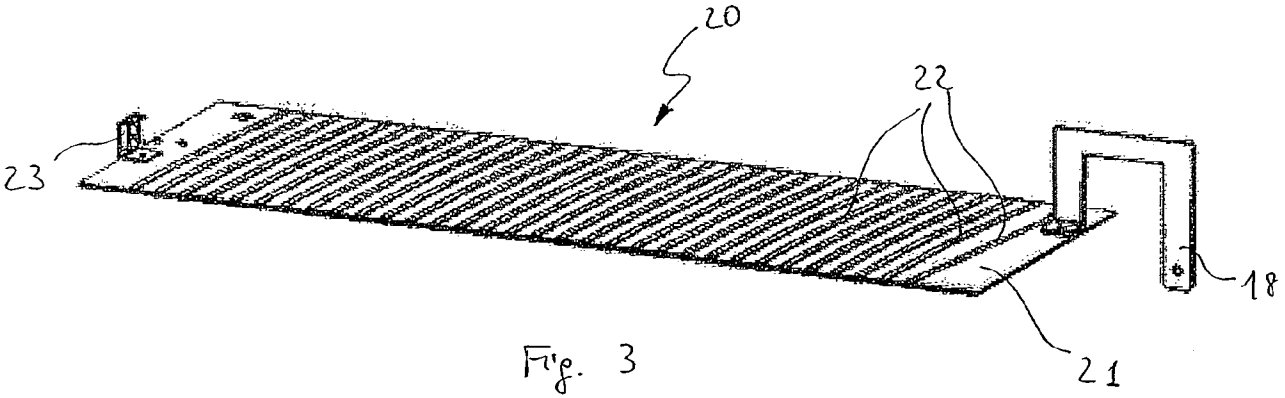
FIG. 3 shows a part of the heater according to FIG. 2.

A heating element of a heater according to the present invention is made in a single piece comprising an insulating supporting element 21 and at least one resistance wire 22, as shown in FIG. 3.

According to a preferred embodiment, illustrated with the aid of the appended figures, said insulating supporting element 21 is a flat plate, for example of rectangular shape.

Different shapes of the insulating supporting element 21 can be provided, in relation to the available space where the heater is to be installed.

According to this embodiment, the resistance wire 22 is wound by machine on said insulating supporting element 21.

Figure 1:
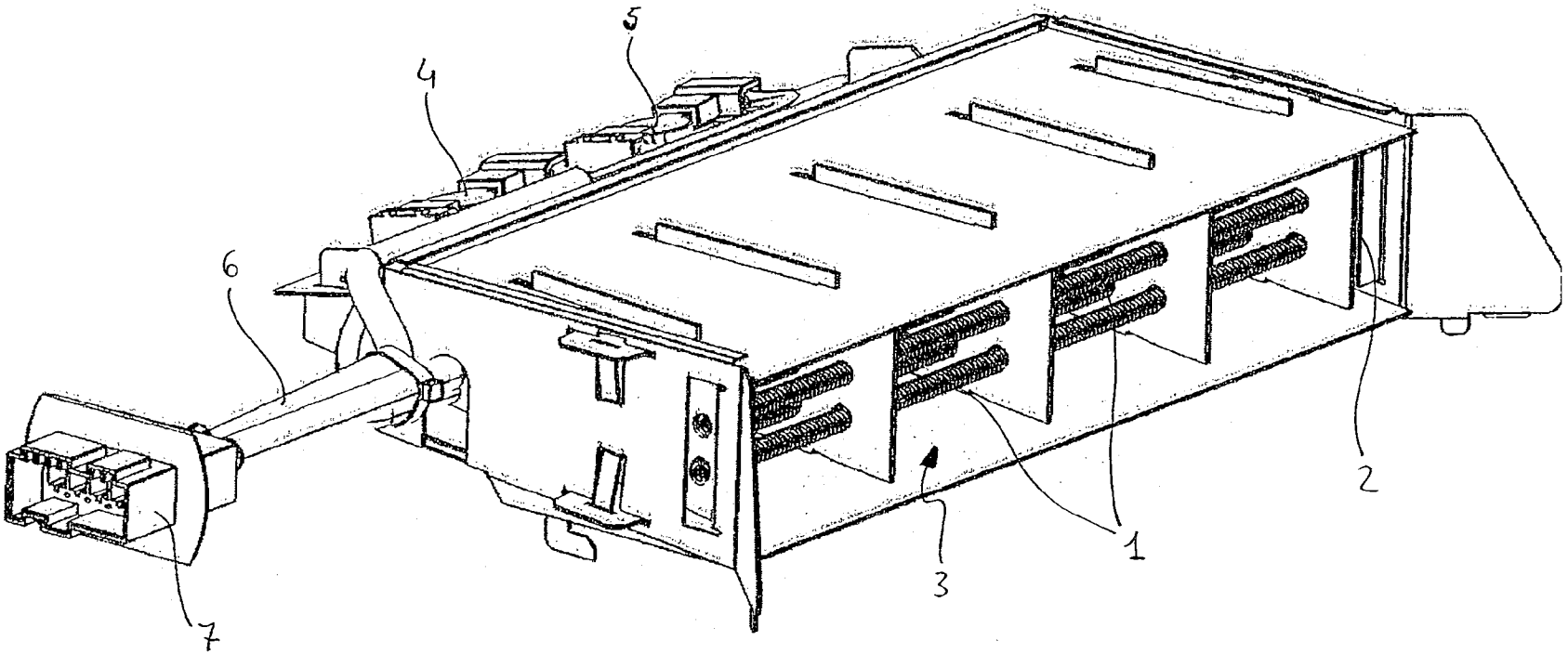
FIG. 1 shows a heater according to the prior art.
Figure 2:
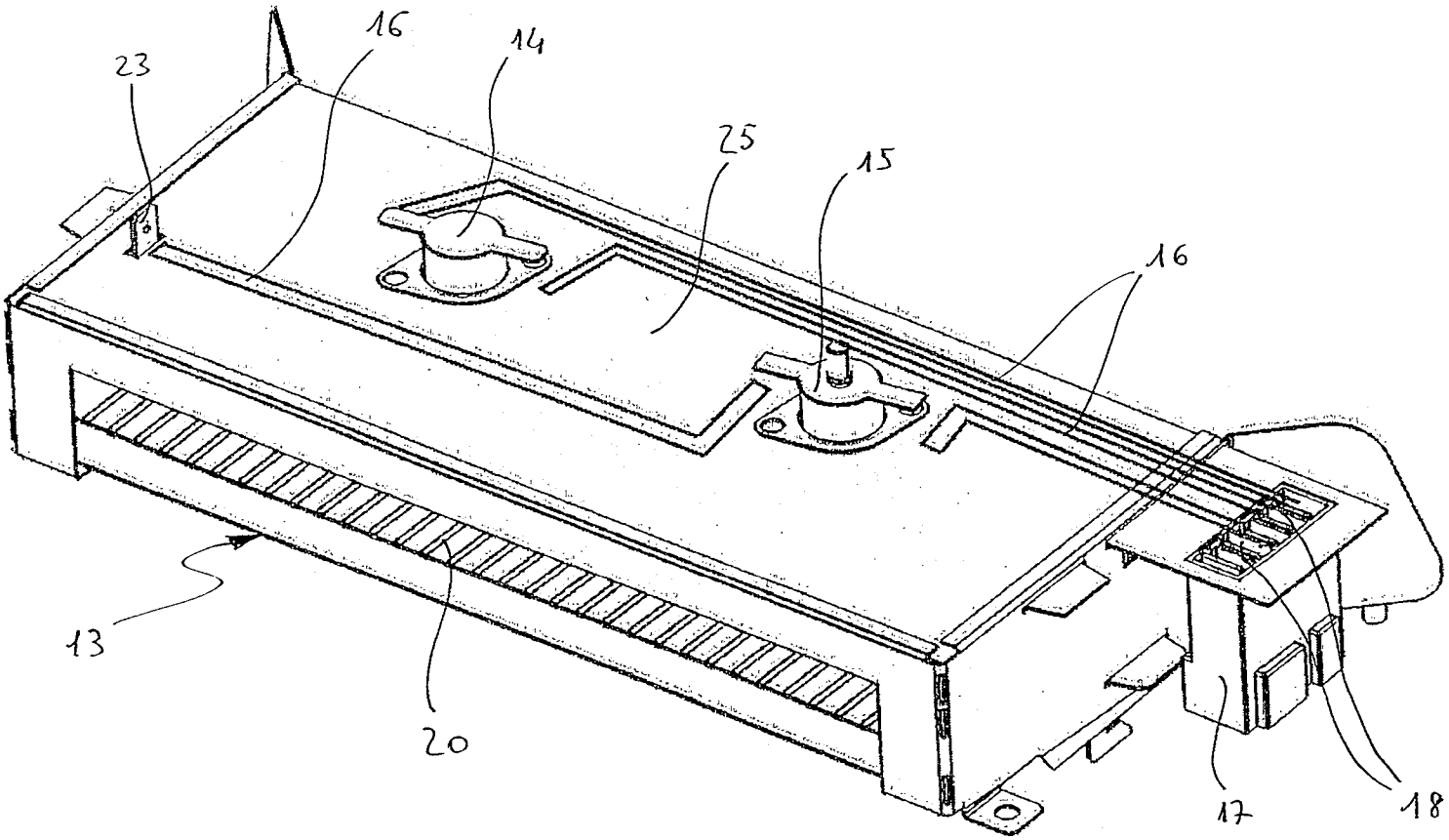
FIG. 2 shows a first embodiment of the heater of the present invention with cut-away parts.

According to the preferred embodiment shown in FIG. 2, the heater comprises a pair of heating elements 20 (only one of these two heating elements 20 can be seen in FIG. 2), arranged in series by a metallic connecting element 23 clamped on both supporting elements 21 in order to intercept an end of each of the respective resistance wires 22.

Preferably, said heating elements 20 are superimposed so as to be parallel but at a suitable distance and said metallic connecting element 23 is clamped on both heating elements 20 corresponding to a first side thereof.

Figure 4:
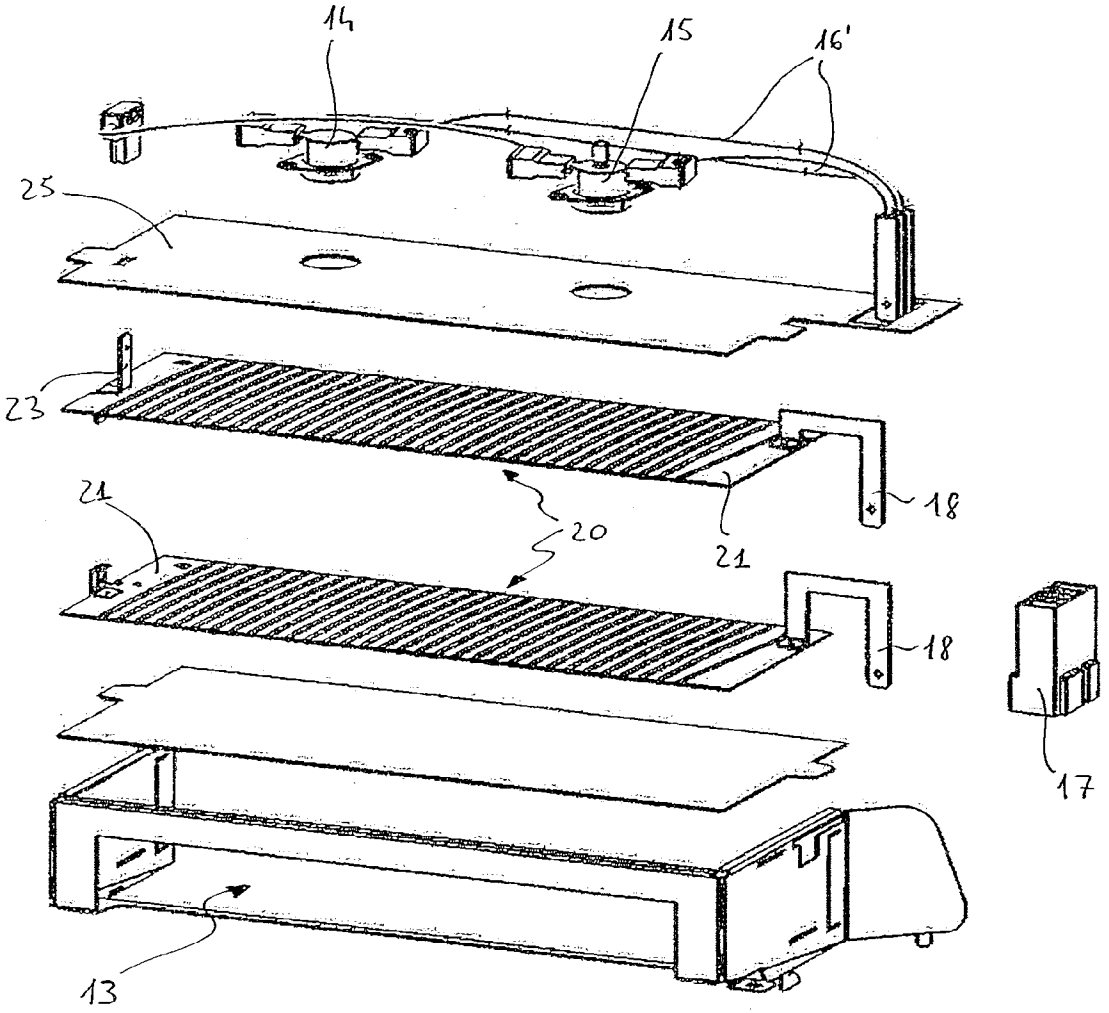
FIG. 4 shows an exploded perspective view of a further embodiment of the heater of the present invention.

An electrical connector 17 comprises electrical pins 18, see for example FIG. 4, which are clamped on both supporting elements 21 corresponding to a second side opposite to said first side.

According to the embodiment shown in FIG. 2, a surface 25 of the housing 13, to which a thermostat 15 and a thermistor 14 are attached, comprises electrical tracks 16 for connection of said components. In this case, said electrical connector 17 comprises further electrical pins, which are able to clamp said surface 25 of housing 13 to tap said electrical tracks 16.

Figure 6:
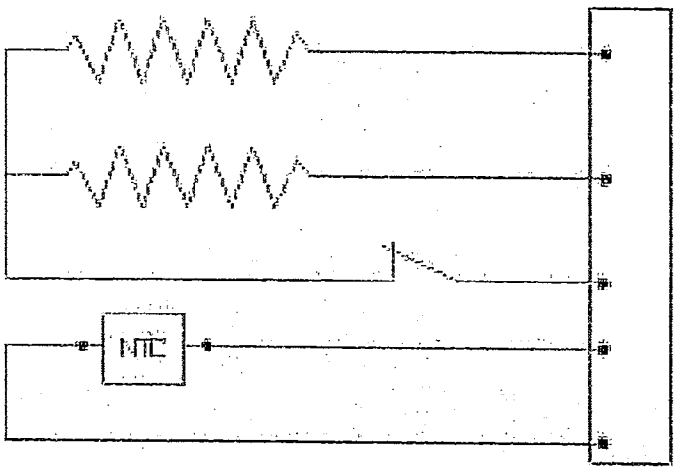
FIG. 6 shows an electric circuit diagram of the components defining the heater shown in FIGS. 2 to 5.

According to the electrical connections depicted in FIGS. 2 and 6, said metallic connecting element 23 is additionally able to clamp said surface 25 of housing 13, tapping an electrical track 16.

Advantageously, according to the embodiment described, there is no wiring; the connections are made by clamping the electrical connector on surfaces, which preferably are flat and parallel to each other, and in particular on the insulating supporting elements 21 and on surface 25 of housing 13.

The tracks can be produced by screen printing or in some other way but essentially are of adequate thickness for the resistive load of the wire.

According to the present invention, the housing can be of any shape.

In the embodiments shown in the drawings, the housing 13 is in the form of a parallelepiped lacking two opposite sides. In said housing, the heating elements 20 are housed so that they are perpendicular to the mouths or end sections of the openings, in order to maximize the heat exchange with respect to an air stream, which, passing through the housing from an inlet to an outlet, opposite one another, flows over said heating elements.

Figure 5:
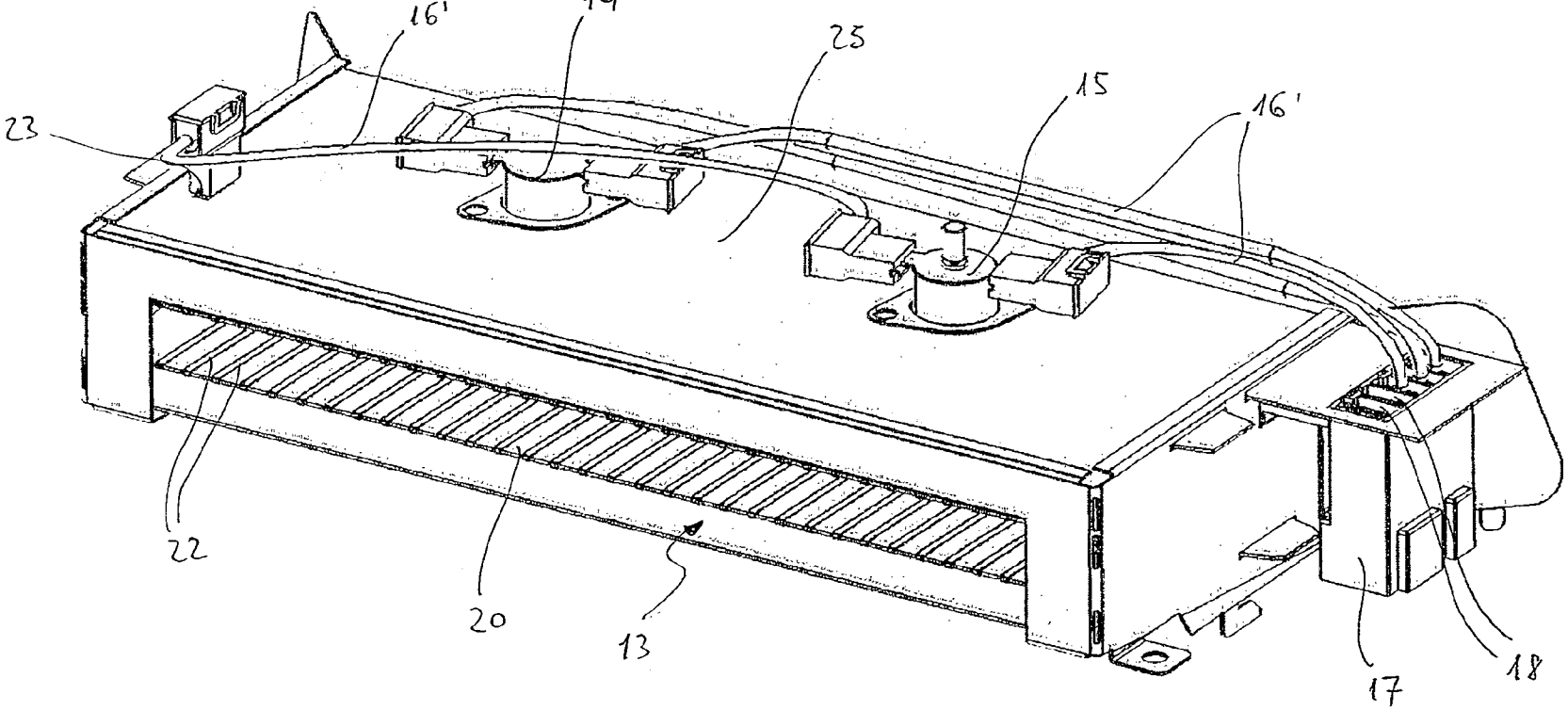
FIG. 5 shows a perspective view of the heater of FIG. 4.

According to a further embodiment represented in FIG. 5, the electrical connections of the thermostat 15 and of the thermistor 14 are made with conventional cables 16' connected by means of an electrical connector 17 that is able to clamp the heating elements 20.

For example, the resistance wires 22 can have a diameter preferably between 0.7 and 1.5 mm, for example 0.95 mm, and can be made of metal of various kinds, for instance FeCrAl—FeNiCr resistance alloys or other alloys suitable for the required application.

According to a further preferred embodiment, the resistance wire 22 can be of flattened shape, producing a flat conductor. Moreover, the supporting element 21 as well as the surface 25 of housing 13 are, for example, made of Micanite (also called mica), ceramic and equivalent materials.

The invention is not limited to heaters for tumble dryers, but can be used in any type of equipment that needs to be combined with a heating element and more generally it relates to electrical devices manufactured by processes similar to those outlined.

The elements and the characteristics illustrated in the various preferred embodiments can be combined, while remaining within the scope of protection of the present application.

The invention claimed is:

1. Electric air heater, in particular for electrical domestic appliances, comprising a housing having two opposite openings and forming an inlet and an outlet for the air stream, said housing having a surface for fixing at least one of a thermostat and a thermistor, said housing being able to accommodate at least one heating element arranged perpendicularly to mouths of said openings, so that the air stream passing through the housing flows over the heating element, an electrical connector provided with electrical pins, wherein said at least one heating element is made of a single piece comprising a flat insulating supporting element on which at least one resistance wire is wound, configured so as to define a substantially flat winding, said electrical connector, is clamped on said heating element or on said surface of the housing, electrical connections of said at least one of a thermostat and a thermistor are made by electrical tracks, formed on said surface of the housing, tapped by said electrical connector that taps also at least one end of said at least one resistance wire, thus eliminating any electric wiring.

2. Heater according to claim 1, comprising a pair of superimposed parallel heating elements arranged in series by a metallic connecting element clamped on both supporting elements in order to intercept an end of each of the respective resistance wires.

3. Method of manufacturing an electric air heater according to claim 1, comprising a stage of making at least one heating element by winding by machine at least one resistance wire directly on a flat insulating supporting element, thus forming a substantially flat winding; clamping an electrical connector having electric pins directly on said supporting element; tapping mechanically, with said electric pins, the resistance wire in a single operation, which can be carried out by machine, thus eliminating the electric wiring.

* * * * *